US012589900B2

(12) United States Patent
Peccetti

(10) Patent No.: US 12,589,900 B2
(45) Date of Patent: Mar. 31, 2026

(54) METHOD AND ASSEMBLY OF WINDING ONE OR MORE BUNDLES WITH STRETCH FILM FROM A REEL

(71) Applicant: COLINES S.P.A., Novara (IT)

(72) Inventor: Eraldo Peccetti, Novara (IT)

(73) Assignee: COLINES S.P.A., Novara (IT)

( * ) Notice: Subject to any disclaimer, the term of this patent is extended or adjusted under 35 U.S.C. 154(b) by 0 days.

(21) Appl. No.: 18/847,631

(22) PCT Filed: Mar. 14, 2023

(86) PCT No.: PCT/IB2023/052446

§ 371 (c)(1),
(2) Date: Sep. 16, 2024

(87) PCT Pub. No.: WO2023/175490

PCT Pub. Date: Sep. 21, 2023

(65) Prior Publication Data

US 2025/0206476 A1 Jun. 26, 2025

(30) Foreign Application Priority Data

Mar. 17, 2022 (IT) ..... 102022000005261

(51) Int. Cl.
*B65B 11/00* (2006.01)

(52) U.S. Cl.
CPC ..... *B65B 11/008* (2013.01); *B65B 2011/002* (2013.01); *B65B 2210/18* (2013.01)

(58) Field of Classification Search
CPC ..... B65B 11/008; B65B 2011/002; B65B 2210/18; B65B 11/025; B65H 20/32; B65H 20/30

(Continued)

(56) References Cited

U.S. PATENT DOCUMENTS 3,353,732 A * 11/1967 Reader ..... G11B 15/58
3,375,963 A * 4/1968 Wang ..... G11B 15/43
242/615.3

(Continued)

FOREIGN PATENT DOCUMENTS

EP 3303144 4/2018
EP 3414167 12/2018

(Continued)

OTHER PUBLICATIONS

International Search Report and Written Opinion received for PCT Serial No. PCT/IB2023/052446 on Jul. 3, 2023, 12 pgs.

*Primary Examiner* — Stephen F. Gerrity
*Assistant Examiner* — Nicholas E Igbokwe
(74) *Attorney, Agent, or Firm* — Merchant & Gould P.C.

(57) ABSTRACT

A method of wrapping bundles is with stretch film from a reel. Bundles include products in transit through a wrapping machine including a wrapping unit having a ring winder which rotatably arranges stretch film around the bundles. During transit through the winding unit, the stretch film is unwound from the reel and passes through a pre-stretching group which generates axial deformation of the film predetermining an elastic return quantity. The axially deformed film interfaces with a vacuum having a vacuum box producing a constant auxiliary tensional stress on the pre-stretched film equal to the head inside the vacuum box. The film is then deposited on the bundles with a constant stress residue at each point of application of the pre-stretched film after adding the constant load generated by the vacuum box, producing bundles completely wrapped with a programmed stress residue.

8 Claims, 5 Drawing Sheets

(58) Field of Classification Search
USPC ..... 226/118.4, 97.2
See application file for complete search history.

(56) References Cited

U.S. PATENT DOCUMENTS

| | | | | |
|---|---|---|---|---|
| 5,404,691 | A * | 4/1995 | Scherer | B65B 13/32 53/399 |
| 5,768,862 | A * | 6/1998 | Mauro | B65B 11/025 53/556 |
| 11,111,038 | B2 * | 9/2021 | Peccetti | B65B 21/245 |
| 2002/0179767 | A1 * | 12/2002 | Rapparini | B65H 20/32 226/118.1 |
| 2012/0180430 | A1 * | 7/2012 | Lavoie | A01F 25/14 53/203 |
| 2016/0200470 | A1 * | 7/2016 | Zoboli | B65B 21/245 53/556 |
| 2017/0057673 | A1 * | 3/2017 | Corberi | B65B 45/00 |
| 2018/0290776 | A1 * | 10/2018 | Ceré | B65B 41/14 |
| 2019/0016488 | A1 * | 1/2019 | Peccetti | B65B 21/245 |
| 2019/0241291 | A1 * | 8/2019 | Peccetti | B65B 35/44 |

FOREIGN PATENT DOCUMENTS

| | | | |
|---|---|---|---|
| WO | 2016193878 | A2 | 12/2016 |
| WO | 2016193878 | A3 | 12/2016 |
| WO | 2017137360 | A1 | 2/2017 |

* cited by examiner

METHOD AND ASSEMBLY OF WINDING ONE OR MORE BUNDLES WITH STRETCH FILM FROM A REEL

CROSS-REFERENCE TO RELATED APPLICATIONS

This application is a National Phase of International Application No. PCT/IB2023052446, filed on Mar. 14, 2023, which claims priority to Italian Patent Application No. 102022000005261, filed on Mar. 17, 2022, the entire contents of which are incorporated herein by reference.

FIELD OF THE INVENTION

The present invention relates to a method and assembly for wrapping one or more bundles with stretch film from reels.

PRIOR ART

In the field of bundle packaging, various types of machines have been developed which "pack" the bundles inside stretch film. An example of a machine and a method of this type is described in patent EP 3414167.

In such a stretch film packaging machine for bundles consisting of one or more products, the presence of at least one wrapping unit is envisaged which arranges the stretch film around the bundle by means of at least one ring wrapping machine. The film is conducted around the bundle and is stably arranged around it thanks to its extensibility characteristics, but does not guarantee equal tension at every point of the bundle due to the geometric inconsistencies it has with respect to the angular wrapping linearity that this method produces.

It should be noted that the bundle, or the individual products that make it up, only minimally have a circular section, i.e. cylindrically shaped, but mostly have a parallelepiped or prismatic shape with more or less marked edges.

The different geometry between the circumference covered by the release point of the film integral with the rotating ring and the section, different from being circular, predominantly rectangular or comparable to it, of the product to be wrapped, means that the tension of the film is not constant and well distributed on the bundle. In other words, by transferring the film onto the product due to a rotation around the center of instantaneous rotation of this system, even at a constant angular envelope velocity, we are in the presence of reactive effects on the film tension due to adjustment/laying down around the bundle that are variable. The sum of these tensioning effects, which are clearly of geometric conjugation, normally lead to a non-homogeneous tensioning on the final bundle or package, resulting in an unsuitable packaging when the product to be wrapped does not have a high structural rigidity.

By unsuitable packaging we mean a deformation of the product, poor stability of the package which causes difficulty in subsequent handling or even a potential for injury to the packaged product.

Furthermore, in the prior art, attempts are made to obtain a correct tensioning of the film being wound on the bundle with so-called dancer systems. In fact, attempts are made to achieve, with these systems, a deposition of the film which is a function of the geometry of the product in order to limit the undesired residual stresses responsible for the deformation effects which can be found on the products.

With such systems known as a dancer, the variation of the position of the film and its tensioning are negatively influenced by the inertial conditions of the masses present in such systems, such as rollers, support structures of the same, non-constant elastic compensation systems.

The masses constituting the dancer or the compensation systems make the bundle subject to an increase in tension of the film caused, for example, by the reversal of motion of these masses during the deposition of the film, due to the effect of natural forces of inertia.

SUMMARY OF THE INVENTION

The main purpose of the present invention is to deposit film on any bundle with a predetermined residual tension, mainly if not exclusively produced by the elastic return of the film due to the action of a programmed pre-stretch, since the mechanical characteristics of the stretchable film are known, in addition to the size of the latter, the desired residual film tension is easily obtainable.

Another object of the present invention is that of realizing a method of winding a bundle which is capable of solving the above mentioned drawbacks of the prior art in a simple, economical and functional way.

The invention relates to a winding method whose sequence of process steps is characterized by the introduction of the punctual control of the axial deformation of the film so that it determines a known and constant elastic residue as well as a buffer system of the same film designed to be the compensation element between the geometric inconsistencies of the element or elements to be packaged with respect to the unwinding linearity that the film has due to the rotation around the product; in order to be effective and constant in the tensional quantity accessory to the winding process, the buffer system is assisted by a negative head system with the aim of eliminating any relevant physical mass element of certain energy perturbation during the suddenness of the compensatory movement.

In particular, to guarantee the fact of being able to deposit the film or the film with any type of tension beyond that pre-generated with the pre-stretch or in any case with an additional tension but in any case determined and controllable, it was identified downstream of the pre-stretch a film deposit compensation system on the package capable of determining a constant and uniformly distributed tensioning residue along the periphery of the product.

The additional tensioning control is guaranteed with a vacuum box whose effect is a tension proportional to the absolute value of the vacuum for the surface of the box interfaced with the film; the moving masses are exclusively those of the film as a reactive element of the vacuum produced. Since the mass of the film is substantially irrelevant whatever the strategy of movement of the film in the vacuum box, it will never have an appreciable relevance of energy addition other than that produced by the vacuum.

The structural and functional characteristics of the present invention and its advantages over the known art will become even clearer and more evident from an examination of the following description, referred to the attached schematic drawings, which show a non-limiting embodiment of the invention itself.

DETAILED DESCRIPTION OF THE INVENTION

Figure 1:
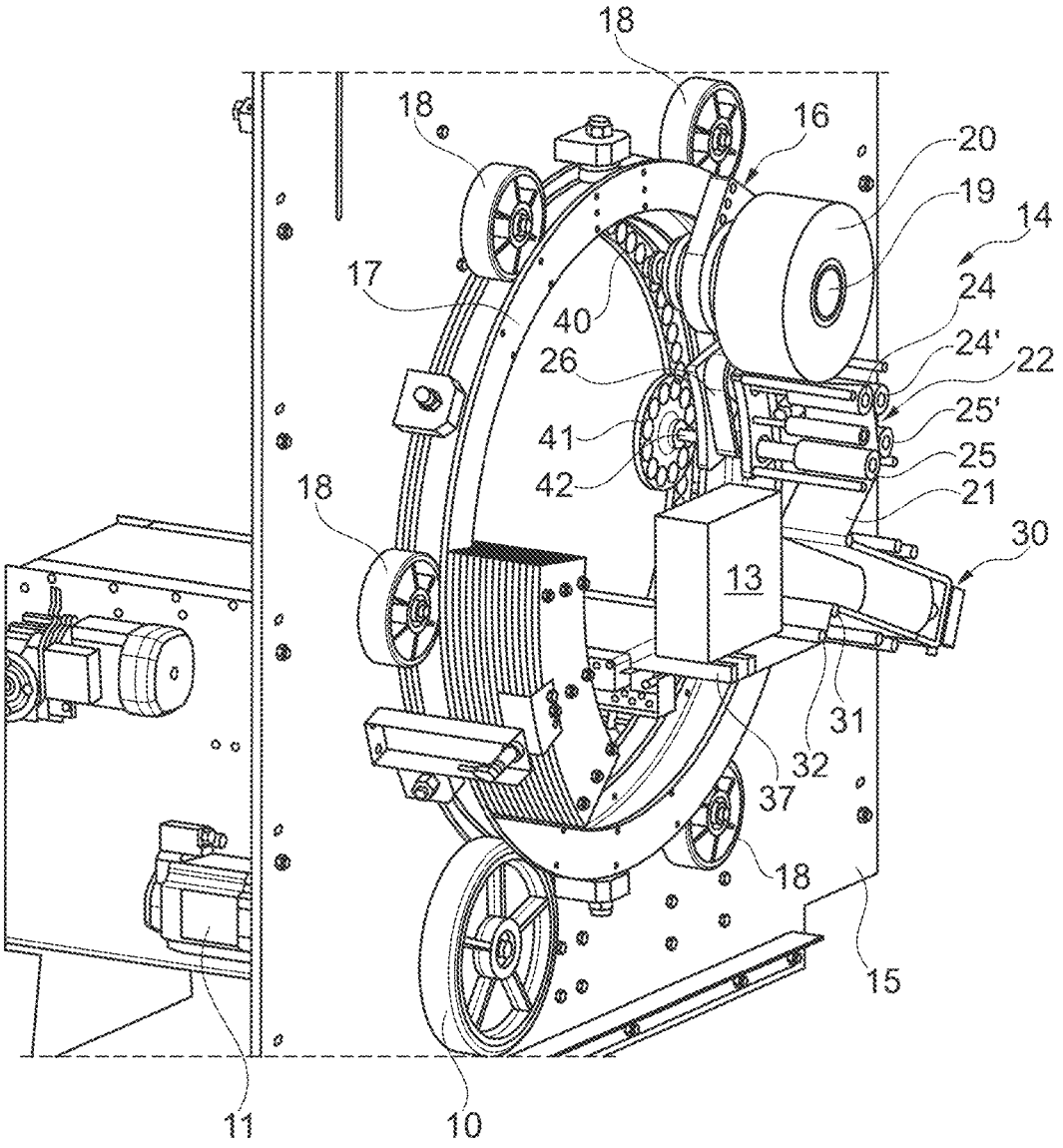
FIG. 1 shows a perspective view of a bundle packaging machine with the method according to the present invention.
Figure 2:
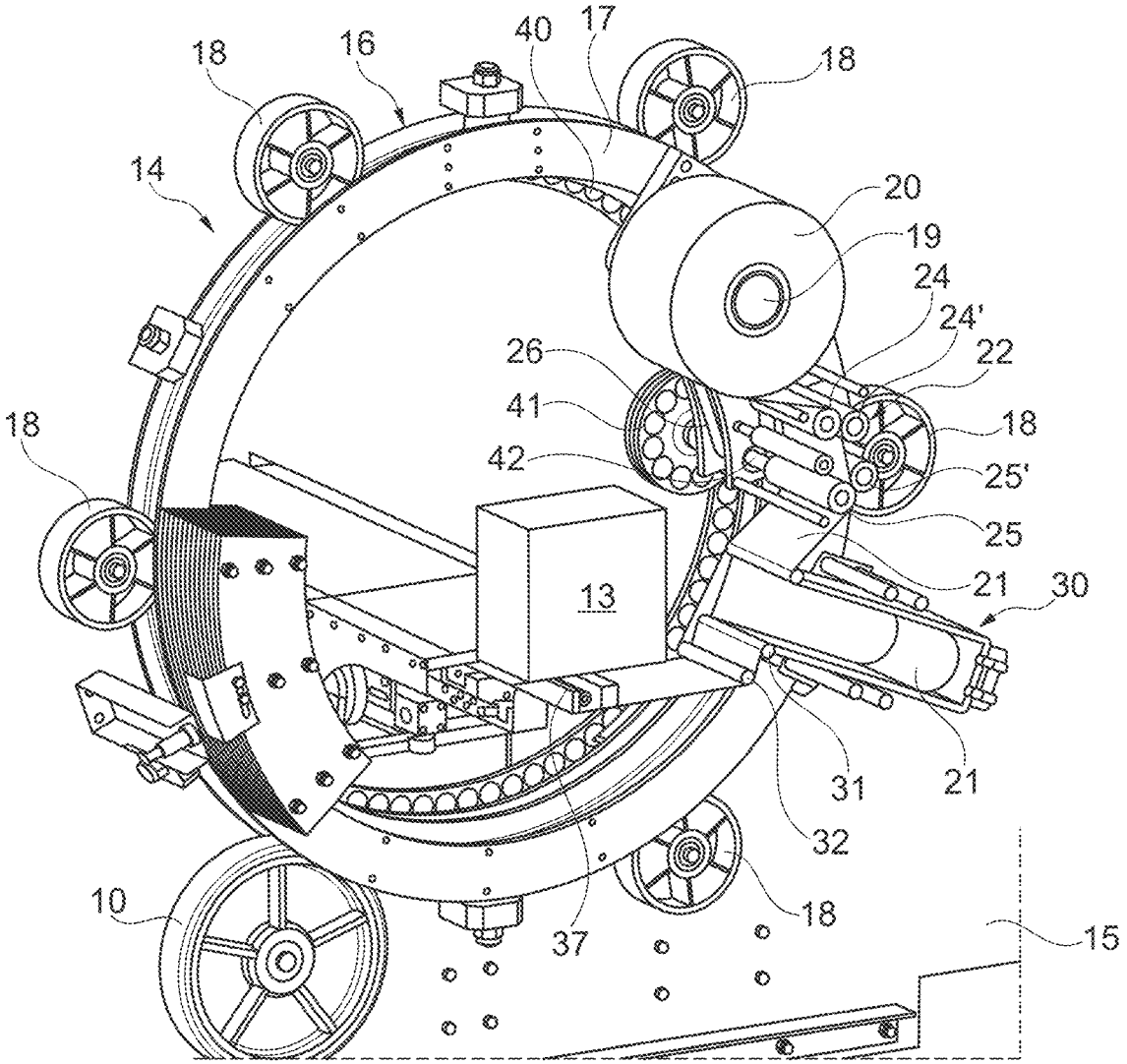
FIG. 2 shows a perspective view from a different direction of the machine shown in FIG. 1.
Figure 3:
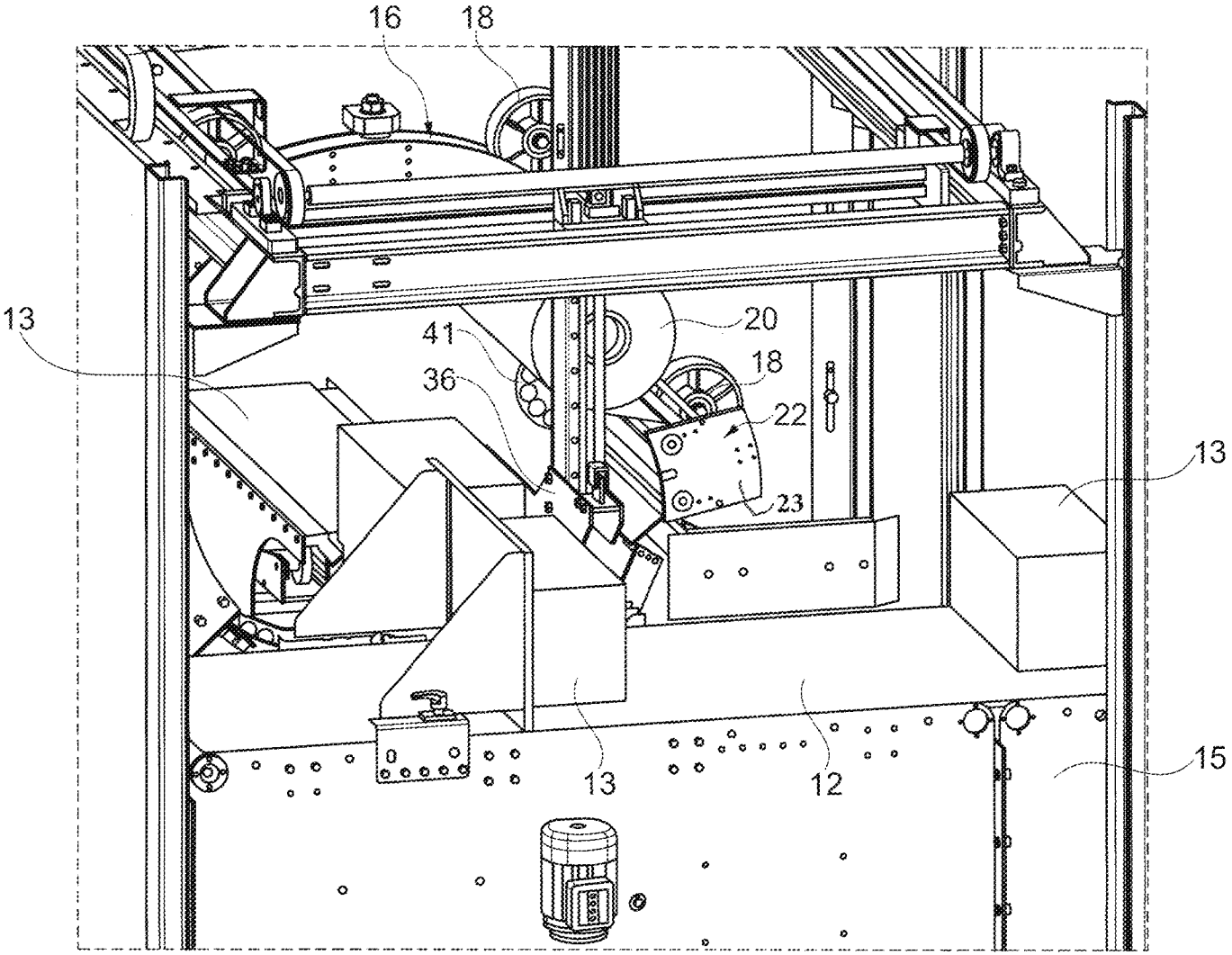
FIG. 3 shows a flow of products to be packaged entering a machine according to FIGS. 1 and 2.

In the following description, for the illustration of the figures, identical reference numerals are used to designate construction elements with the same function. Furthermore, for clarity of illustration, some reference numbers may not be repeated in all the figures.

Indications such as "vertical" and "horizontal", "upper" and "lower" (in the absence of other indications) must be read with reference to the assembly (or operating) conditions and referring to the normal terminology in use in current language, where "vertical" indicates a direction substantially parallel to that of the gravity force vector "g" and horizontal a direction perpendicular to it.

With reference to the exemplifying and non-limiting figures, an embodiment of a wrapping portion of a bundle packaging machine is shown.

In fact, a conveyor belt (12) is envisaged which carries a bundle (13) forward towards a positioning unit (36) which, moving in the direction perpendicular to that of advancement of the bundle (13) on the belt (12), moves the bundle on the plane support (37) in a suitable position for winding. We have indicated "bundle" (13) that which is intended to be wrapped and which can include both one or more bundles and one or more products.

The wrapping unit (14) comprises a frame (15) which supports at least one ring wrapper (16) which operates on bundles (13) carried forward by the positioning unit (36). The wrapping unit (14) is also arranged astride the support plane (37) and the bundles (13) that advance inside it.

This ring wrapper (16) comprises a ring (17) which is rotatable with respect to guide rollers (18), arranged on the frame (15). This ring (17) is arranged in a plane perpendicular to the advancement direction of the bundles (13) and is rotated by a gearmotor (11) by means of a control friction roller (10).

A reel holder (19) for a reel (20) of stretch plastic film (21) is integrally mounted on the ring (17).

Further downstream of the reel holder (19) with reel (20) there is a pre-streching unit (22) which allows to have a constant physical pre-stretch of the dispensed film (21).

This pre-stretching unit (22), in a non-limiting example thereof, comprises a plate (23) integral with the ring (17). The plate (23) supports an insertion of the stretch film (21) comprising a first driven rubber roller (24) followed at a distance by a second motorized rubber roller (25). To allow the correct adhesion of the film on the rollers (24) and (25), the pre-stretching system (23) is equipped with the rollers (24') and (25') in radial contact and interfering with the rollers (24) and (25) to guarantee the correct amount of friction necessary for the film to be homokinetic with the rollers (24) and (25).

The roller (24) and the roller (25) are connected by a mechanical transmission (26) which determines a rotational ratio proportional to the programmed stretching amount.

At the outlet downstream from the pre-streching unit (22) there is a vacuum box (30) which performs the function of a buffer, consequently representing a film tank. This vacuum box (30) is arranged so as to be capable in its volume of compensating the difference between the average envelope speed of the film (21) during the rotation of the ring (17) with respect to the punctual deposition speed of the film (21) on a bundle (13). Furthermore, the vacuum box (30) is capable of simultaneously depositing the film on the bundle with a tension obtained by regulating the depressive capacity of the system generating the vacuum. The final tension on one or more wrapped bundles will be the result of the deposition tension and that due to the elastic return of the film as a consequence of the pre-stretch imposed by the pre-streching unit (22). The provision of the vacuum box (30), in which the film moves within its volume, substantially maintains a constant tension equal to the amount of vacuum that we are going to regulate inside the vacuum box for the surface of the section of box interface to the film.

Inside the volume of the vacuum box (30) there is a sensor system, for example an ultrasound sensor (50) which detects the presence and position of the film so as to maintain a substantially constant tension on the film (21) and an adequate amount of film.

The film (21) coming out of the vacuum box (30) is arranged and directed by means of a pair of rollers (31), (32) which direct it towards one or more bundles (13).

It is also envisaged that a magnetic track (40) is arranged associated with the ring (17), which magnetic track (40) rotates and causes a wheel or disc with a magnetic track (41) to rotate, the shaft (42) of which is supported by the plate (23) of the pre-stretching unit (22).

The wheel with magnetic track (41) thus drives the second rubber roller (25), arranged integral with the shaft (42).

The wheel with magnetic track (41) is a satellite disc which receives the drive through the magnetic track (40) according to speed strategies consistent with the correct amount of development necessary for the finished packaging envelope.

Therefore, the pre-streching unit (22) and therefore the unwinding of the film (21) are performed by motorizing the rubber roller (25) of the pre-streching unit with a magnetic track system.

In fact, as mentioned, the magnetic track (40), rotating at a suitable speed, rotates the wheel with magnetic track (41) keyed onto the same shaft (42) of the rubberized pre-streching roller (25) at the desired speed. The rotation speed of the magnetic track (40) is a function of the rotation speed of the ring (17) of the reel holder, of the average unwinding speed and of any compensations regulated by the analysis of the quantity of film present in the vacuum box which can oscillate between two thresholds from a completely full position to an exhaustion position.

Figure 4:
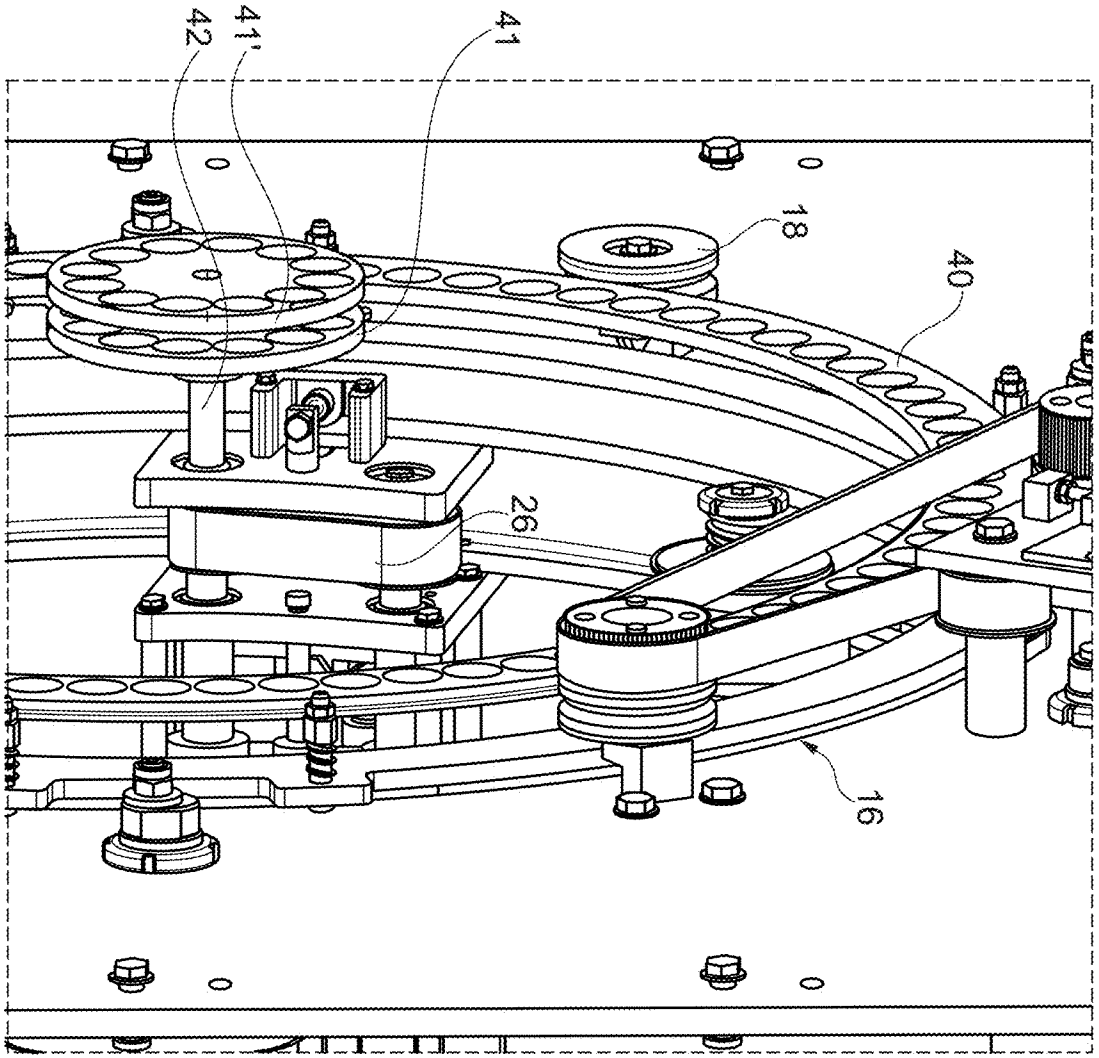
FIG. 4 shows a second embodiment of magnetic transmission used in such machines.
Figure 5:
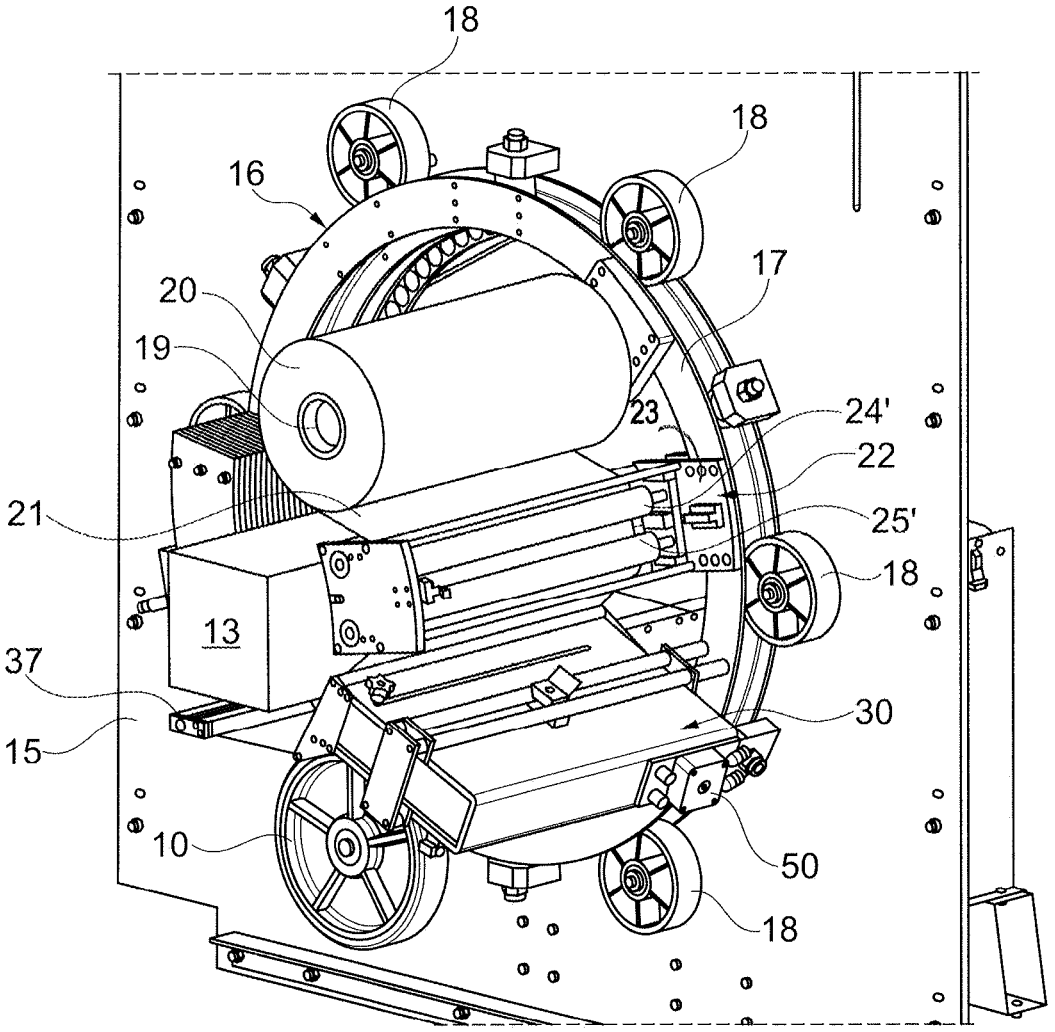
FIG. 5 shows another perspective view from a different direction of the machine shown in FIG. 1.

The magnetic transmission described above in a non-limiting manner, in a second embodiment, could be structured as in FIG. 4 with the extension of the shaft (42) and the equipping of a second magnetic disk (41') with the purpose of not causing axial loads of the magnetic transmission disk (40) and to guarantee a possible more homogeneous control of the magnetic transmission of couple.

The vacuum box (30) has the task of depositing the film on the bundle (13) with tension determined by a pneumatic suction system and equipped with a suction partialization specula in the atmosphere necessary to finely and minimally determine the quantity of residual negative pressure inside the vacuum box.

Substantially the vacuum box (30) performs the same task currently performed by the so-called "dancers" or "dancing-roll" with the advantage, however, of not having inertial masses which, due to the suddenness of the law of motion of the winding of the film cause, due to the inertia of their components, uncontrolled extra tensions in the packaging of the wrapped bundle.

The vacuum case (30) in fact has the weight of the film (21) as its only inertial mass, which is decidedly negligible.

Such a system or machine described or in an alternative form allows to implement a winding method according to the present invention.

The method of wrapping bundles with stretch film from reels provides that one or more bundles (13), made up of one or more products, is or are in transit in a packaging machine.

The machine, which as mentioned provides at least one wrapping unit (14) consisting of at least one ring wrapper (16) which, by rotating, arranges the stretch film around one or more bundles (13), further provides that the film (21) unwinds from a reel (20) arranged on a rotating ring (17) of the ring wrapping machine and is made to arrange itself around one or more bundles (13), during the transit of the latter in the wrapping unit.

In particular, the winding method of the present invention provides that a) in a first step, said stretch film (21) which is being unwound from said reel (20) passes through a pre-stretching group (22) which generates an axial deformation of said film (21) predetermining an elastic return quantity thereof, b) in a second step wherein said stretch film axially deformed in step a) is caused to interface with a vacuum box (30) having a known volume positioned downstream of the pre-stretching group (22), which guarantees the possibility of a buffer (tank) capable in its volume of compensating for the difference between the average development rate of the film during the rotation of the ring (17) with respect to the specific deposition rate of the film on one or more bundles (13) regardless of its/their geometry and producing a constant auxiliary tensional stress on the pre-stretched film equal to the value of the head inside the vacuum box (30) for the projection of the interface surface of the film with said vacuum box, c) in a third step wherein the film is deposited on said one or more bundles (13) with a constant stress residue at each point of application of said pre-stretched film after the addition of the constant load generated by the vacuum box (30), producing one or more bundles completely wrapped with a programmed stress residue in each point of the perimeter of the one or more bundles (13), wherein the depositing of said film is effected through at least one complete revolution of said ring (17) around said one or more bundles (13).

According to the present invention, therefore, a system or a machine has been created which implements a winding method which solves the problems of the prior art.

The main advantages are:

Produce a bundle wrapped in stretch film with punctual and constant control of the wrapping tension, using a magnetic transmission system from the outside to the inside without contacts, with torque limitation, without the need for particularly refined geometric coherence, consequently to the advantage of low-cost structures.

The activity of these magnetic transmission structures governs a pre-streching unit which allows for constant physical deformation and a programmed and homogeneous elastic resultant of the film.

The vacuum box downstream of the pre-streching system allows for the possibility of a buffer (tank) capable in its volume of compensating the difference between the average speed of development of the film during the rotation of the ring with respect to the punctual speed of deposit of the film on a bundle regardless of its geometry. The function of the vacuum box, in which the film moves within its volume, is to maintain a constant tension equal to the amount of vacuum that we are going to regulate inside the vacuum box for the interface surface with the film.

Consequently, the film around the bundle, regardless of any type of geometry, will have a residual degree of tension given by the sum of the amount of vacuum per interface surface that exists in the vacuum tank with the film plus the tension due to the return elastic of the film as a result of the pre-stretch performed.

The aim mentioned in the preamble of the description is thus achieved.

The invention claimed is:

1. A method for wrapping bundles with stretch film from a reel, wherein one or more bundles, composed of one or more products, is/are in transit in a packaging machine that has at least one wrapping unit comprising at least one ring wrapping machine which, on rotating, arranges the stretch film around one or more bundles, wherein said film is unwound from a reel arranged on a rotating ring of said ring wrapping machine and is caused to be arranged around one or more bundles, during the transiting of the bundles in the wrapping unit, the wrapping method comprising:

a) a first step, in which said stretch film which is being unwound from said reel passes through a pre-stretching group which generates an axial deformation of said film predetermining an elastic return quantity, b) a second step wherein said stretch film axially deformed in step a) is caused to interface with a vacuum box having a known volume positioned downstream of the pre-stretching group, which provides a buffer having a volume compensating for a difference between an average development rate of the film during rotation of the ring with respect to a deposition rate of the film on one or more bundles regardless of geometry of the one or more bundles and producing a constant auxiliary tensional stress on the pre-stretched film equal to a value of a head inside the vacuum box for projection of an interface surface of the film with said vacuum box, c) a third step wherein the film is deposited on said one or more bundles with a constant stress residue at each point of application of said pre-stretched film after addition of the constant load generated by the vacuum box, producing one or more bundles completely wrapped with a programmed stress residue in each point of a perimeter of the one or more bundles, wherein the depositing of said film is effected through at least one complete revolution of said ring around said one or more bundles.

2. The method according to claim 1, wherein said pre-stretching group is powered by a magnetic track system, wherein said magnetic track system is associated with said rotating ring and rotates and causes a wheel or disc with a magnetic track to rotate, wherein a magnetic track shaft is supported in said pre-stretching group to cause traction action for unwinding the stretch film.

3. The method according to claim 1, wherein the film inside the volume of the vacuum box maintains a substantially constant tension of the stretch film equal to the value of the head inside the vacuum box for the projection of the interface surface of the film with said vacuum box regardless of a quantity of film occupying the volume of said vacuum box.

4. The method according to claim 1, wherein said predetermined tensioning on the stretch film in said pre-stretching group of the stretch film is generated by a first driven rubberized roller followed, at a distance, by a second motorized rubberized roller which are connected by a mechanical transmission which creates a rotational ratio proportional to a stretching quantity programmed, wherein complementary rollers are provided in radial contact and interfering with the first and second roller guaranteeing the correct amount of friction necessary for the film to be homokinetic with said rollers.

5. An assembly for wrapping bundles with stretch film from a reel in a packaging machine of one or more bundles comprising one or more products, wherein said packaging machine comprises at least one wrapping unit comprising at least one ring wrapping machine which, on rotating, arranges stretch film around one or more bundles, wherein said film is unwound from a reel arranged on a rotating ring of said ring wrapping machine and is caused to be arranged around one or more bundles, during transiting of the one or more bundles in the wrapping unit, wherein the assembly comprises:

a pre-stretching group of the stretch film which generates an axial deformation of said stretch film which is being unwound from said reel and is passed through said pre-stretching group, a vacuum box which continuously receives said stretch film provided with said axial deformation generated in the pre-stretching group, wherein said vacuum box is provided with a volume in an interior within which the film moves and keeps axial deformation of the film generated in said pre-stretching group substantially constant as the film passes forward in the interior, wherein said vacuum box is arranged downstream of said pre-stretching group and both said vacuum box and said pre-stretching group are arranged on said rotating ring around said one or more bundles, and wherein said assembly provides a supporting plane which receives said one or more bundles moved by a positioning unit into a position for being wrapped within said rotating ring of said ring wrapping machine.

6. The assembly according to claim 5, wherein a magnetic track is associated with said rotating ring and rotates and causes a wheel or disc with a magnetic track to rotate, wherein a shaft of the magnetic track is supported in said pre-stretching group and drives a rubberized roller on which said film passes.

7. The assembly according to claim 5, wherein a system of sensors, which detects presence and position of the film, is arranged inside the volume of the vacuum box.

8. The assembly according to claim 5, wherein said pre-stretching group of the stretch film comprises a first driven rubberized roller followed at a distance by a second motorized rubberized roller which are connected by a mechanical transmission which creates a rotational ratio proportional to a predetermined amount of stretching, wherein complementary rollers are provided in radial contact and interfering with the first and second rollers guaranteeing a correct amount of friction for the film to be homokinetic with said rollers.

* * * * *